United States Patent [19]

Luchi

[11] 4,015,443

[45] Apr. 5, 1977

[54] KNITTED FABRICS HAVING PATTERN EFFECTS

[76] Inventor: Vinicio Luchi, Via Wilfredo Pareto 43, Prato, Florence, Italy

[22] Filed: Apr. 4, 1975

[21] Appl. No.: 565,258

[30] Foreign Application Priority Data

Apr. 19, 1974 Italy ..... 9412/74

[52] U.S. Cl. ..... 66/9 R; 66/190; 66/107

[51] Int. Cl.[2] ..... D04B 9/12

[58] Field of Search ..... 66/190, 180, 169, 170, 66/10, 9, 8, 13, 104, 107

[56] References Cited

UNITED STATES PATENTS

| | | | |
|---|---|---|---|
| 130,866 | 8/1872 | Ramsdell | 66/10 |
| 430,300 | 6/1890 | Rhome et al. | 66/10 |
| 627,786 | 6/1899 | Waterfield | 66/10 |
| 627,945 | 6/1899 | Waterfield | 66/190 |
| 732,434 | 6/1903 | Nicholls | 66/10 |
| 2,094,180 | 9/1937 | Mishcon | 66/190 X |
| 2,662,383 | 12/1953 | Lombardi | 66/107 X |
| 2,836,970 | 6/1958 | Deiss et al. | 66/9 |
| 3,832,867 | 9/1974 | Luchi | 66/17 |
| 3,859,824 | 1/1975 | Krylov et al. | 66/10 |
| 3,884,053 | 5/1975 | Niederer | 66/190 |

OTHER PUBLICATIONS

Lancashire, J. B., "Designing with Laid-In Threads in Single Knit Fabrics", Knitting Times, vol. 41, No. 5, pp. 38 & 39.

*Primary Examiner*—Ronald Feldbaum

[57] ABSTRACT

A knitted fabric formed on a knitting machine includes longitudinal and transverse weft yarns incorporated into the fabric during knitting. A further transverse weft yarn is incorporated into the fabric and is interlinked with the courses of stitches of the fabric. Part of this further yarn, as determined by the needle selection, is visible on a surface of the fabric and serves to provide a pattern effect.

5 Claims, 7 Drawing Figures

A
B
C
1
5
3
7
7A
7B

KNITTED FABRICS HAVING PATTERN EFFECTS

FIELD OF THE INVENTION

The present invention relates to knitted fabrics.

SUMMARY OF THE INVENTION

According to the invention there is provided a process for forming a fabric using a knitting machine having needles, comprising knitting on the machine a fabric having courses of interlinked stitches, incorporating longitudinal and first transverse weft yarns in the fabric, incorporating a further transverse weft yarn in the fabric, said further transverse weft yarn being interlinked with the zones of the fabric in which the stitches of one course of knitted stitches are interlinked with those of an adjacent course, and providing a needle selection such that the further weft yarn appears in selected parts of the surface of the fabric.

According to a further aspect of the invention, there is provided in a knitting machine, an array of slidable needles, sinkers cooperating with said needles, means operative to feed longitudinal weft yarns between contiguous needles, yarn guide means for at least one stitch yarn, yarn guide means for a first transverse weft yarn in correspondence of each feed in front of the needles, yarn guide means for a further weft yarn downstream of said guide means for said first transverse weft yarn, feed means operative to feed the stitch yarn from behind the needles and present same at the front of the needles, first and second sinkers in correspondence of each interspace between contiguous needles, and means for actuating said sinkers separately, said actuating means comprising means for advancing the first sinker to move the further transverse weft yarn behind the needles before the raising thereof, and means for advancing the second sinker before the raising thereof, and means for advancing the second sinker after an at least partial raising of the needles, to bring the said further yarn behind the needles which have not been raised and against the raised needles, the stitches being formed after raising of all the needles.

According to a still further aspect of the invention, there is provided a fabric formed on a knitting machine having needles, said fabric comprising a knitted fabric structure having courses of interlinked stitches, transverse and longitudinal weft yarns incorporated in the fabric structure, a further transverse weft yarn interlinked with the stitches of the fabric structure in the zone in which the stitches of one of the courses are interlinked with those of an adjacent course, said further weft appearing in selected portions of the surface of the fabric, as a function of the needle selection of the needles whereby said further yarn passes in front of or behind the needles during the formation of the fabric.

BRIEF DESCRIPTION OF THE DRAWINGS

The invention will now be described, by way of example only, with reference to the accompanying diagrammatic drawings, in which.

DESCRIPTION OF THE PREFERRED EMBODIMENT

Figure 1:
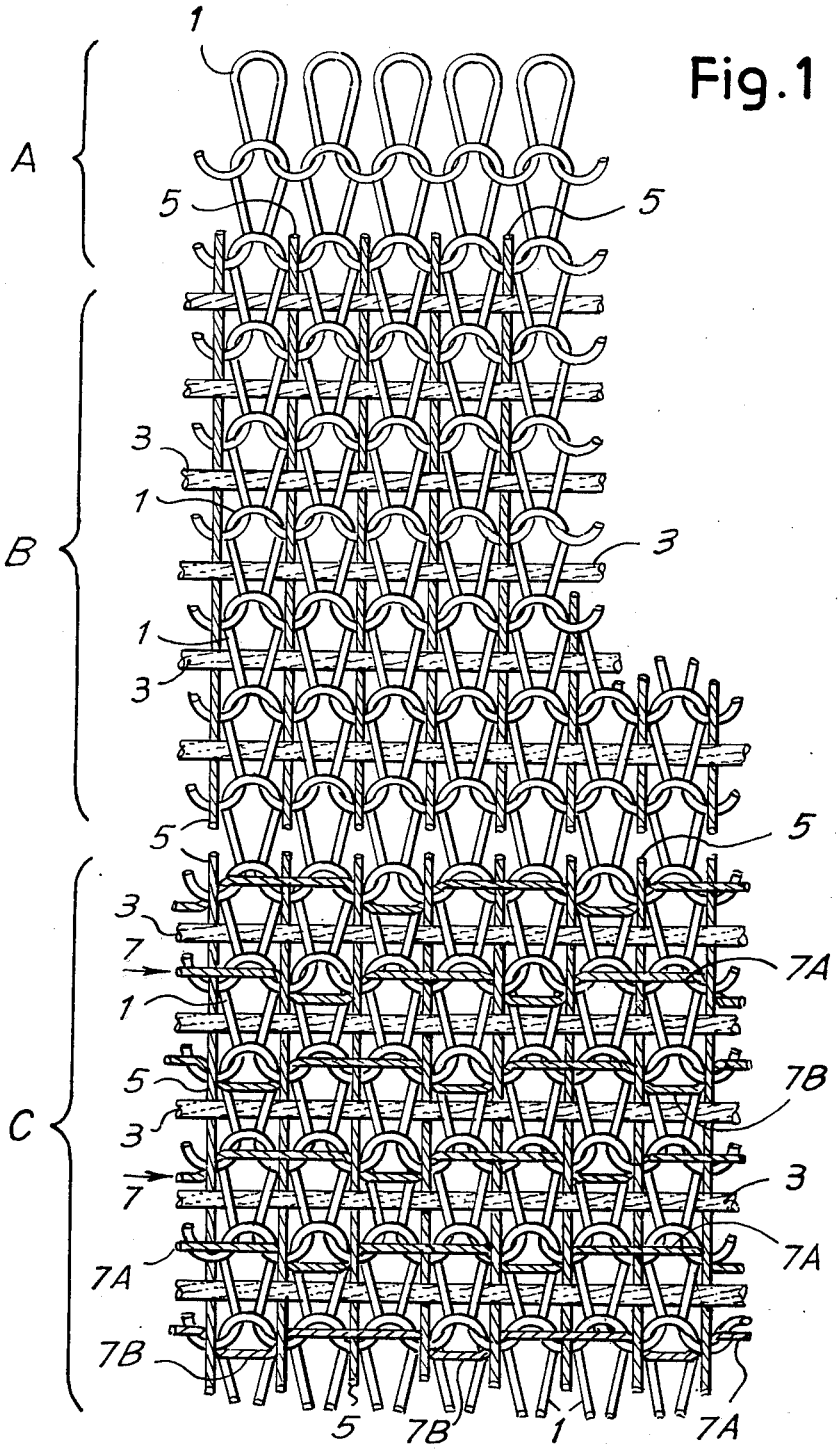
FIG. 1 shows previously proposed fabrics and a fabric according to the present invention.

With reference to FIG. 1, there is shown in the zone indicated by A a conventional knitted fabric formed by means of a single yarn or thread 1 with a uniform plain stitch. In the zone indicated by B, there is shown a weft knitted fabric in which, in addition to the yarn 1, there are provided transverse weft yarns 3, and longitudinal weft yarns 5, which serve to stiffen or reinforce the fabric in both directions such that the fabric has similar properties to a woven fabric. The longitudinal weft yarns 5(which may also be termed as "warp yarns") extend parallel to the rows of stitches, that is the wales, knitted by a given needle and are located in front of these stitches, while the transverse weft yarns 3 extend along the courses of stitches formed by the same yarn and are located behind these stitches but in front of the longitudinal weft yarns 5. The fabrics shown in the zones A and B have some disadvantages in particular the inability of incorporating pattern effects comparable to those obtained with a conventional shuttle loom or the like, and a relatively low stiffness.

The fabric shown in zone C of FIG. 1 overcomes the above disadvantages. In the fabric shown in Zone C, in addition to the transverse and longitudinal weft yarns 3 and 5, there is provided an additional substantially transverse weft yarn 7 which is interlinked with the stitches formed with the yarns 1 in correspondence of the engaging zone between adjacent courses of stitches, the weft yarns 7 being arranged partly at the front of the fabric and partly at the back of the fabric. The portions of the weft yarns 7 arranged at the front of the fabric correspond to a selection of needles for causing a partial lifting of the selected needles before the presenting of the additional weft yarns as will be described hereinafter. More particularly, as shown in FIG. 1, each weft yarn 7 has portions 7A which appear on the front surface 1 of the fabric and portions 7B which do not appear on the front surface. The portions 7B are in correspondence of a single stitch, and the portions 7A are in correspondence of two contiguous stitches. The arrangement of the portions 7A and 7B may, however, differ from that shown and may vary both in the same course and between subsequent courses of the same fabric, and between different fabrics or between different zones of the same fabric, as required by the pattern to be obtained.

The fabric indicated in the zone B is comparable to a woven fabric formed on a shuttle loom or the like, without any pattern effect, while the fabric indicated in zone C represents the same arrangement as that of zone B with the addition of transverse weft yarns 7 which increases the stiffness of the fabric; by varying the needle selection, pattern effects can be obtained which are similar to those provided by a conventional shuttle loom, for example fish-bone or diagonal pattern effects.

Figure 2:
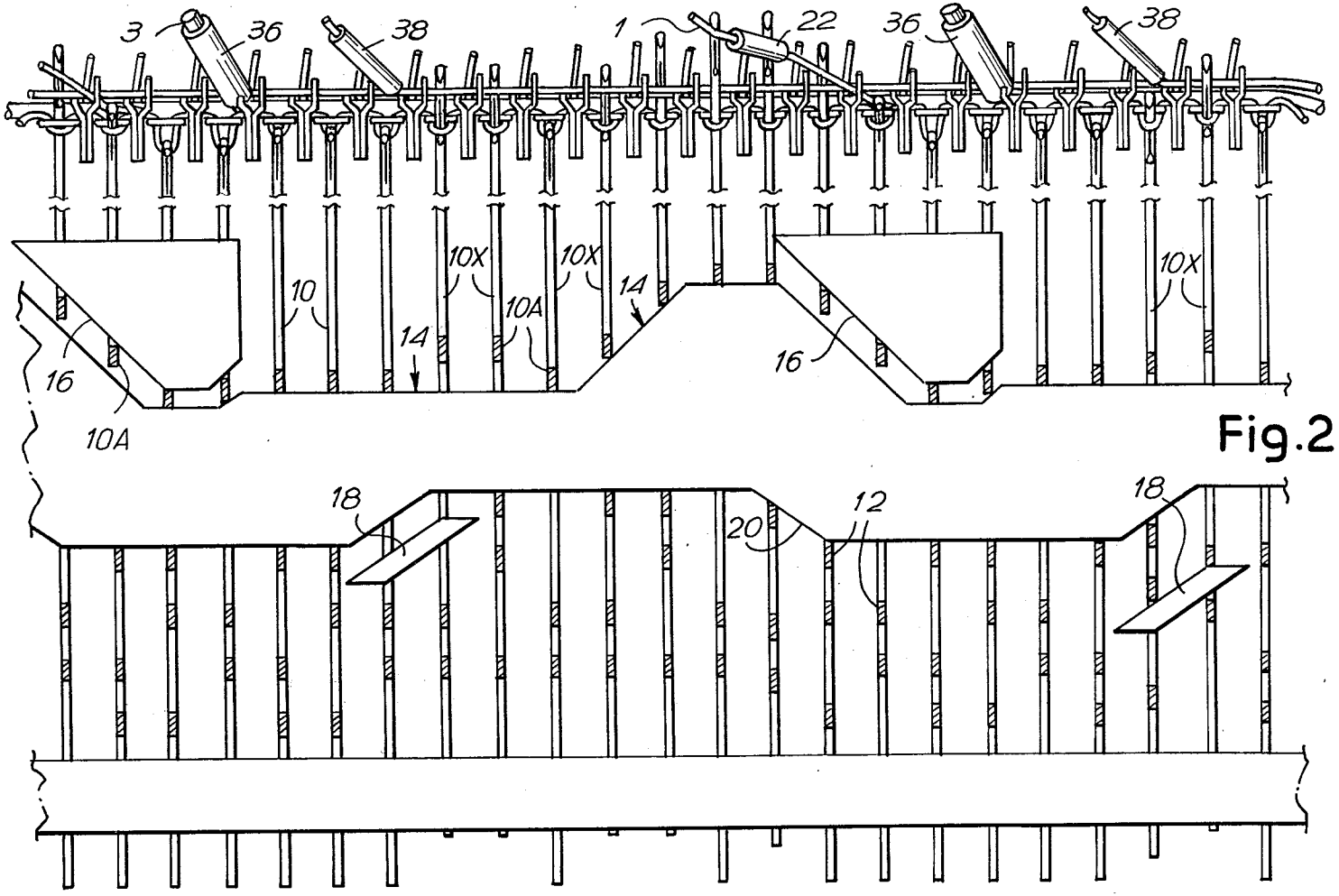
FIG. 2 is a developed side elevation showing the operational parts of a knitting machine for forming the fabric.
Figure 3:
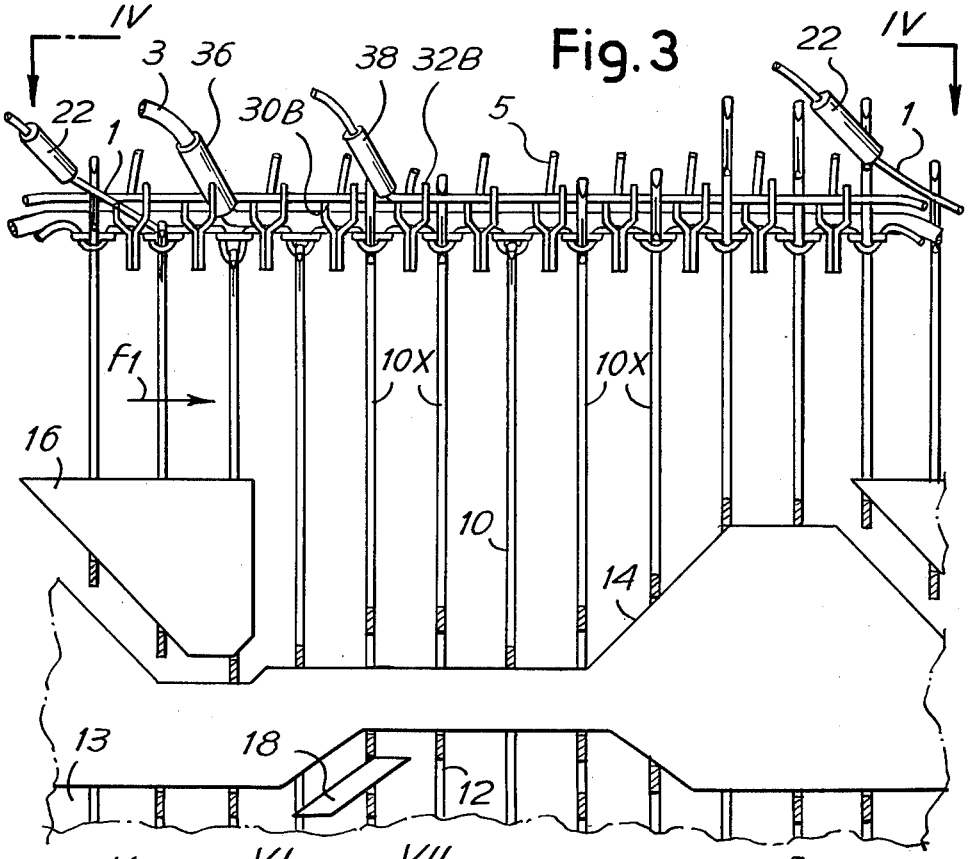
FIG. 3 shows a portion of FIG. 2 to an enlarged scale.

In FIGS. 2 to 7 there is shown in a simplified and schematic manner, a knitting machine having means for forming such a fabric. The machine comprises needles 10 which cooperate with jacks 12; the needles and jacks slide in tricks of a bed or cylinder 13 or other like member. The needles are raised and lowered by means of cam profiles 14 and 16 respectively which act on butts 10A of the needles, while the needle selection is obtained by means of the butts of jacks 12, with per se known arrangements and with the aid of cam profiles 18 for lifting the butts, and cam profiles 20 for subsequently lowering the butts. As can be seen in FIG. 2, the cam 18 determines—in correspondence of each yarn feed and in advance thereof—the partial lifting of two contiguous needles 10X, while after every two lifted needles, there follows a needle which is not so lifted. The partial lifting selection of the needles 10X is cancelled by the subsequent profile 14, which raises all the needles to seize the stitch yarn 1 and to clear the previous stitch under the open latch. The yarn 1 is fed by a yarn guide 22, which feeds the yarn in the zone of maximum lift of the needles (operated by the profile 14) and in the lowering zone of the needles operated by the cam profile 16. The yarn guide 22 is carried by a structure which extends from behind the needles in order to prevent inteference by the yarn 1 with the other yans ( 3, 5, 7 ) which are fed in front of the needles.

Figure 4:
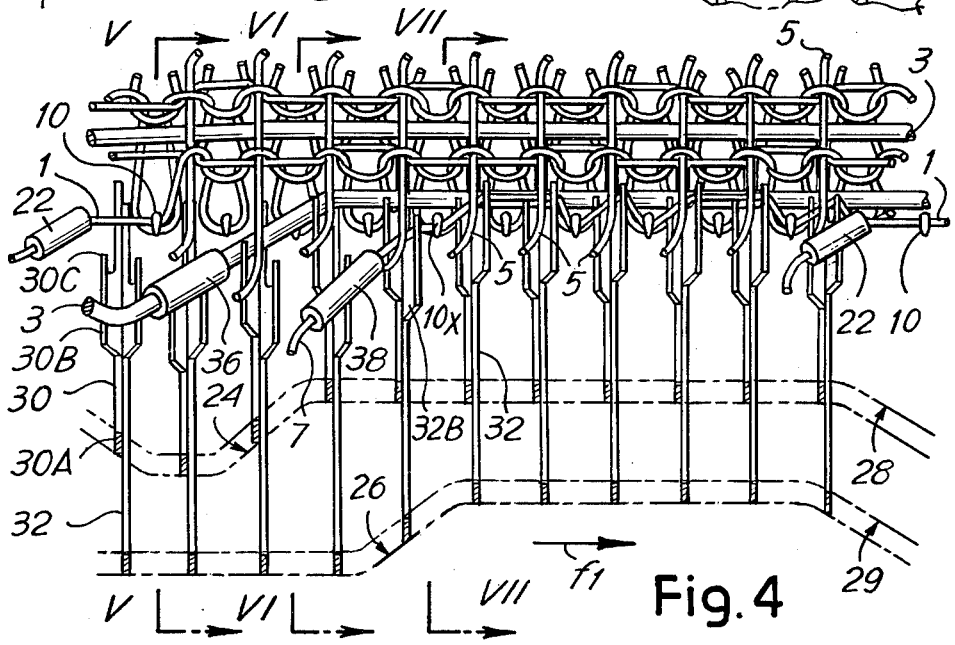
FIG. 4 is a plan view taken on line IV—IV of FIG. 3.
Figure 5:
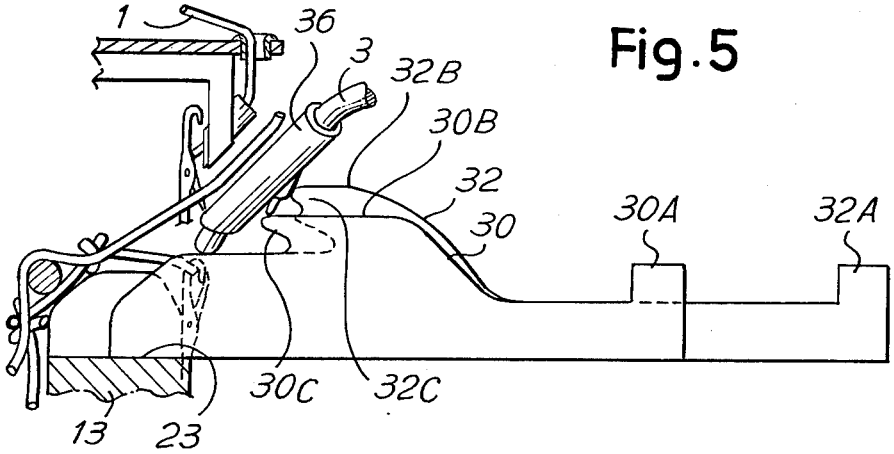
FIGS. 5, 6 and 7 are sections taken on lines V—V, VI—VI and VII—VII, respectively, of FIG. 4.
Figure 6:
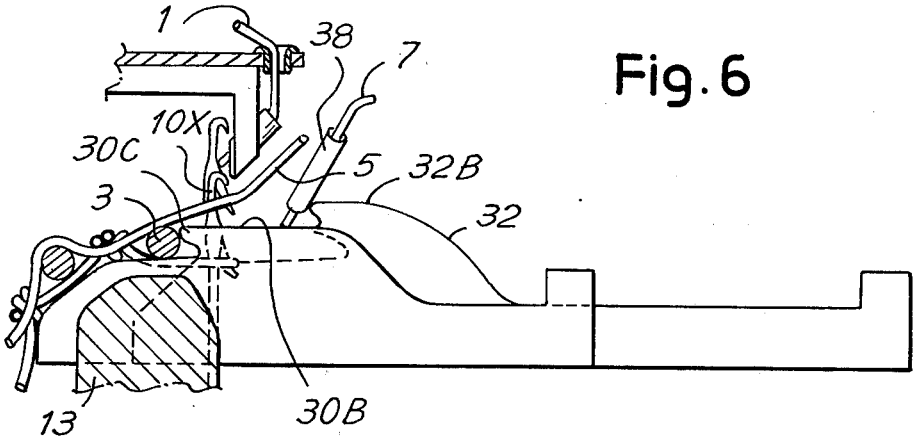
Figure 7:
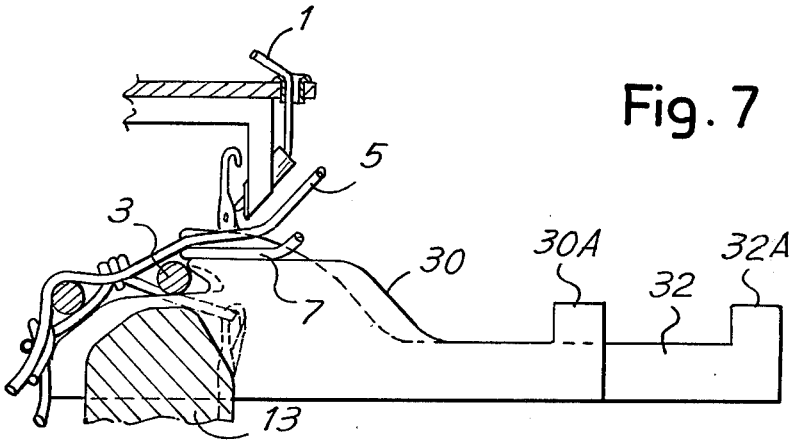

In correspondence of each space or gap between subsequent needles 10 there is provided on a structure extending perpendicularly the bed 13, a pair of sinkers arranged in the same groove 23 (see FIG. 5) of the bed 13 and movable by control means operated by advancing profiles 24 and 26 respectively, and corresponding retracting profiles 28 and 29(as shown in FIG. 4). Reference numeral 30 indicates one of the sinkers of the pair provided in correspondence of each gap between the needles, this sinker being operated via a butt 30A by the profiles 24, 28; numeral 32 denotes the other sinker of the pair, which is operated via a butt 32A by the profiles 26, 29. The sinker 30 has in its upper portion, a flattened profile 30B, followed by a tip 30C; the portion of the sinker 30 including the parts 30B, 30C, is bent so as to be displaced from the path of the sinker 32 as can be seen in FIG. 4. The sinker 32 has a profile 32B above the zone of the profile 30B, and is followed by a tip 32C, which acts at a level slightly above that of the profile 30B; the recess defining this tip 32C may be followed by a recess substantially corresponding to that of the recess defining the tip 30C; the portion of the sinker 32 having the profile 32B and the tip 32C is bent away from the path of the sinker 30, and thus in a direction opposite to the bending of the sinker 30. Due to the presence of these bent portions of the two sinkers 30 and 32 there is defined by the upper portions of each pair of sinkers 30, 32, a channel or groove which is clearly shown in FIG. 3. The weft yarn 5 is centered in correspondence of this groove the yarn being guided in the groove and is not moved out of the groove; in this manner any obstruction to the movement of the needle latch by the yarn 5 is obviated.

The sinkers 30 are advanced by the profiles 24 with a predetermined advance with respect to the sinkers 32 which are advanced by the profile 26, the direction of movement of the needles and sinkers with respect to the cams being indicated by arrow *F*1. There is provided on the needle bed 13 in correspondence of the advancing zone of the sinkers 30, a yarn guide 36 which feeds the transverse weft yarn 3 in front of the needles. The advance of the sinkers 30 and thus of the tips 30C effects the seizing of the yarn 3, which is thus advanced so as to be located behind the path of the needles 10 and 10X which are in their fully lowered or inoperative position. Immediately after this movement of the yarn 3, the profile 18 acts to partly lift some of the needles, for instance the pairs of needles 10X spaced from a needle which remains in its lowered position. The needle selection may, of course, be different than that described and shown. A yarn guide 38 which is also located front of the needles presents at this point the weft yarn 7; the yarn 7 is laid on the upper profile 30B of the sinker 30 in its advanced position and is seized by the tip 32C of the sinker 32, when the latter reaches the profile 26 and is advanced thereby; in correspondence of the partly lifted needles 10X, the yarn 7 remains in front of the needles since it is urged against these needles by the tip 32C of the sinker 32, while in correspondence of the needles which remain in their lowered position, the weft yarn 7 is advanced to behind the path of the needles.

In this array of the sinkers and transverse weft yarns 3 and 7, all the needles are lifted by the cam profile 14 which cancels the selection to which the needles 10X have been subjected and brings all the needles up to the clearing level of the previous stitch under the seizing tip of the yarn 1 fed by the yarn guide 22 for forming another course of stitches; the lifting of the needles serves to retain the weft yarn 3 behind the needles, the additional weft yarn 7 in front of the needles 10X and behind the other needles, and the longitudinal weft yarn 5 between the weft yarn 3 and the stitches being formed with the yarn 1. After forming the stitches or during said forming, the profiles 28 and 29 effect retraction of the sinkers. The fabric thus obtained is as shown in zone C of FIG. 1 and comprises a knitted fabric 1 reinforced by a longitudinal weft yarn 5 (which need not be present or similar in correspondence of all the gaps or spaces between the contiguous needles), by a transverse weft yarn 3 and by an additional transverse weft yarn 7 interlinked in a desired manner with the fabric 1 to appear on a surface of the fabric to form a pattern effect.

What is claimed is:

1. A process for forming a fabric using a knitting machine having needles, said process comprising knitting on the machine a fabric having courses of interlinked stitches, incorporating longitudinal and first transverse weft yarns in the fabric, incorporating a further transverse weft yarn in the fabric, said further transverse weft yarn being interlinked with the zones of the fabric in which the stitches of one course of knitted stitches are interlinked with those of an adjacent course, and providing a needle selection such that the further weft yarn appears in selected parts of the surface of the fabric.

2. A process according to claim 1, wherein the first transverse reinforcing yarns are fed prior to the needle selection for said further transverse weft yarn.

3. In a knitting machine, an array of slidable needles, sinkers cooperating with said needles, means operative to feed longitudinal weft yarns between contiguous needles, yarn guide means for at least one stitch yarn, yarn guide means for a first transverse weft yarn in correspondence with each feed in front of the needles, yarn guide means for a further weft yarn downstream of said guide means for said first transverse weft yarn, feed means operative to feed the stitch yarn from behind the needles and present the same at the front of the needles, first and second sinkers in correspondence with each interspace between contiguous needles, and means for actuating said sinkers separately, said actuating means comprising, means for advancing the first sinker to move the further transverse weft yarn behind the needles before the raising thereof, and means for advancing the second sinker after an at least partial raising of the needles, to bring said further yarn behind the needles which have not been raised and against the raised needles, the stitches being formed after raising of all the needles or further needles.

4. A machine according to claim 3, wherein the second sinker is higher than the first sinker and acts in correspondence with the back of the first sinker.

5. A machine according to claim 4, wherein the first and second sinkers are shaped to provide divergent portions which define guide means for the longitudinal weft yarn.

* * * * *